US011772386B2

(12) United States Patent
McNestry

(10) Patent No.: US 11,772,386 B2
(45) Date of Patent: Oct. 3, 2023

(54) THERMAL TRANSFER PRINTER

(71) Applicant: VIDEOJET TECHNOLOGIES INC., Wood Dale, IL (US)

(72) Inventor: Martin McNestry, Nottingham (GB)

( * ) Notice: Subject to any disclaimer, the term of this patent is extended or adjusted under 35 U.S.C. 154(b) by 112 days.

(21) Appl. No.: 17/484,906

(22) Filed: Sep. 24, 2021

(65) Prior Publication Data

US 2023/0094581 A1 Mar. 30, 2023

(51) Int. Cl.
*B41J 2/325* (2006.01)
*B41J 33/34* (2006.01)

(52) U.S. Cl.
CPC ..... *B41J 2/325* (2013.01); *B41J 33/34* (2013.01)

(58) Field of Classification Search
CPC ..... B41J 2/315; B41J 2/32; B41J 2/325; B41J 33/34; B41F 16/00; B41F 16/0006; B41F 16/0026; B41F 16/0033
See application file for complete search history.

(56) References Cited

FOREIGN PATENT DOCUMENTS

CN 109562627 A * 4/2019 ..... B41J 2/035

* cited by examiner

*Primary Examiner* — Kristal Feggins
(74) *Attorney, Agent, or Firm* — Wolter Van Dyke Davis, PLLC; Robert L. Wolter

(57) ABSTRACT

There is provided a thermal transfer printer 1, which comprises: a printhead 5; a tape drive configured to cause an inked ribbon 7 to be advanced past the printhead 5 so as to allow ink to be removed from the inked ribbon by the printhead and transferred to a substrate during a printing operation; and a printhead carriage 11 on which the printhead 5 is mounted, wherein the printhead carriage 11 is supported by a rail 34 coupled to a body 2 of the printer, and the rail 34 extends along a direction parallel to a direction of travel of the inked ribbon 7; wherein the printhead carriage 11 further comprises a first structure 40 which is arranged to engage with a second structure 50 coupled to the body 2 of the printer, and wherein the first and second structures 40, 50 are configured such that the printhead carriage 11 is rotatable around the rail 34 but a rotation of the printhead carriage around the rail remains within a predetermined range.

21 Claims, 9 Drawing Sheets

THERMAL TRANSFER PRINTER

TECHNICAL FIELD

The present disclosure relates to a thermal transfer printer. More specifically but not exclusively, the present disclosure relates to a thermal transfer printer which improves the pressure uniformity between its printhead and a substrate to be printed upon.

BACKGROUND

Thermal transfer printers use an ink carrying ribbon. During printing, ink carried on the ribbon is transferred to a substrate which is to be printed on. To cause the transfer of ink, the printhead is brought into contact with the ribbon using, for example, an electromagnetic or pneumatic drive unit, and the ribbon is brought into contact with the substrate. The printhead contains printing elements which, when heated, whilst in contact with the ribbon, cause ink to be transferred from the ribbon and onto the substrate. Ink will be transferred from regions of the ribbon which are adjacent to printing elements which are heated. An image can be printed on a substrate by selectively heating printing elements which correspond to regions of the image which require ink to be transferred, and not heating printing elements which correspond to regions of the image which require no ink to be transferred.

Ideally, uniform pressures shall be established between each of the printing elements and the substrate to be printed on in order to ensure the print quality. However, this may be difficult to achieve in practice, because the printing elements and the surface of the substrate may be misaligned such that over-pressure or under-pressure may occur between some of the printing elements and the substrate.

It is an object of some embodiments of the present disclosure to provide a novel thermal transfer printer which obviates or mitigates at least some of the disadvantages of prior art thermal transfer printers, whether set out above or otherwise.

SUMMARY

According to a first aspect of the present disclosure, there is provided a thermal transfer printer comprising:

a printhead;

a tape drive configured to cause an inked ribbon to be advanced past the printhead so as to allow ink to be removed from the inked ribbon by the printhead and transferred to a substrate during a printing operation; and a printhead carriage on which the printhead is mounted, wherein the printhead carriage is supported by a rail coupled to a body of the printer, and the rail extends along a direction parallel to a direction of travel of the inked ribbon; and wherein the printhead carriage further comprises a first structure which is arranged to engage with a second structure coupled to the body of the printer, and wherein the first and second structures are configured such that the printhead carriage is rotatable around the rail but a rotation of the printhead carriage around the rail remains within a predetermined range.

In other words, the first and second structures allow the printhead carriage to rotate around the rail relative to the body of the printer, but within a limited angular range. By allowing the printhead carriage to rotate around the rail, the printhead is able to adapt its orientation with respect to the surface of the substrate, so as to ensure the printing quality. By restricting the rotation of the printhead carriage to be within a predetermined range, the printhead is prevented from rotating excessively about the rail, causing difficulty in fitting the inked ribbon. Further, the contact between the printhead and the substrate can be easily established and maintained during printing operations.

The rail may be made of metal. The printhead carriage may be made of a low friction plastic material.

The first and second structures may be configured such that, when the first structure abuts against the second structure, the rotation of the printhead carriage reaches an end point of the predetermined range.

In other words, the second structure acts as a stopper to stop the rotation of the printhead carriage from exceeding the predetermined range.

The predetermined range may be at least approximately 0.25 degree.

The printhead may comprise printing elements which are arranged in a one-dimensional linear array, and which, when heated, whilst in contact with the inked ribbon, cause ink to be transferred from the ribbon and onto the substrate.

The predetermined range may be selected such that a maximum misalignment of the array of printing elements with respect to a neutrally aligned substrate is at least 0.25 millimetres. The misalignment may represent a difference of a first linear distance between one end of the array and the substrate and a second linear difference between the other end of the array and the substrate. In an example, the maximum misalignment is approximately +/−0.55 mm.

The predetermined range may be selected such that the maximum misalignment of the array of printing elements with respect to a neutrally aligned substrate is between approximately 10% and approximately 50% of a nominal print distance between the printhead and the substrate. In an example, the maximum misalignment is approximately 27.5% of the nominal print distance.

The predetermined range may not exceed approximately 5 degrees.

The predetermined range may be approximately 2 degrees.

The predetermined range may comprise a first sub-range away from the body of the printer and a second sub-range towards the body of the printer. The first sub-range may be identical the second sub-range. The predetermined range may be +/−1 degree from a neutral position of the printhead carriage.

The first and second structures may be configured such that, a rotation of the printhead carriage relative to the body of the printer remains within a first predetermined limit in a first direction away from the body of the printer, and remains within a second predetermined limit in a second direction towards the body of the printer.

One of the first structure and the second structure may comprise a first part and a second part which are arranged such that, when the first part abuts against the other of the first structure and the second structure, the rotation of the printhead carriage reaches the first predetermined limit, and when the second part abuts against the other of the first structure and the second structure, the rotation of the printhead carriage reaches the second predetermined limit.

The other of the first structure and the second structure may be arranged between the first and second parts.

A distance between the first and second parts may be greater than a width of the other of the first structure and the second structure along a third direction that is parallel to a surface of the body of the printer.

Advantageously, the other of the first structure and the second structure is able to move (to a limited extent) between the first and second parts without abutting against the first/second part. This allows the printhead carriage to rotate relative to the body of the printer, but within a relatively small angular range.

The printhead carriage may comprise a surface facing the body of the printer, and the first structure may be coupled to the surface of the printhead carriage.

The rail may be fixedly coupled to the body of the printer. By "fixedly coupled", it is meant that the rail cannot move relative to the body of the printer and that one or more intervening elements may be connected between the rail and the body of the printer.

The thermal transfer printer may further comprise a support plate secured to the body of the printer, wherein the support plate comprises a pair of brackets and the rail is connected between the pair of brackets.

The thermal transfer printer may further comprise a printhead carriage drive assembly configured to drive the printhead carriage so that the printhead carriage and the printhead moves linearly along the rail.

The first structure may be configured to move linearly with respect to the second structure during a linear motion of the printhead carriage along the rail.

As such, the first and second structures would not obstruct the linear motion of the printhead carriage during printing operations.

The printhead carriage may comprise a gear rack. The printhead carriage drive assembly may comprise a motor, and a circular gear which is caused to rotate by energization of the motor. The circular gear may be arranged to engage with the gear rack such that a rotation of the circular gear causes linear motion of the printhead carriage along the rail.

The rail may be located directly above a centreline of the printhead.

The thermal transfer printer may further comprise a drive housing, wherein the drive housing is configured to house the printhead carriage drive assembly, and wherein the drive housing is securable to the body of the printer.

The drive housing may be removably secured to the body of the printer. The drive housing may be securable to the body of the printer by retaining clips. The drive housing may be formed as a molded plastic part.

The tape drive may comprise a take-up spool support for supporting a spool core onto which inked ribbon can be wound to form a take-up spool. The take-up spool support may be configured to permit the spool core to rotate about a rotation axis extending substantially perpendicular from the body of the printer. The take-up spool support may extend in a fourth direction away from the body of the printer.

The tape drive may further comprise a supply spool support, the supply spool support extending in the fourth direction away from the body of the printer.

The thermal transfer printer may further comprise a user interface provided on a user interface surface of a user interface housing, wherein the user interface housing extends in the fourth direction away from the body of the printer.

The user interface surface may be substantially parallel to the body of the printer. The user interface housing may be integrally formed with the body of the printer.

The thermal transfer printer may further comprise a printhead in/out drive assembly configured to move the printhead towards and away from the substrate, the printhead in/out drive assembly being supported by the printhead carriage.

According to a second aspect of the present disclosure, there is provided a thermal transfer printer comprising:

a printhead;

a tape drive configured to cause an inked ribbon to be advanced past the printhead so as to allow ink to be removed from the inked ribbon by the printhead and transferred to a substrate during a printing operation; and a printhead carriage on which the printhead is mounted, wherein the printhead carriage is supported by a rail coupled to a body of the printer, and wherein the printhead carriage is configured to move linearly along the rail, and rotate around the rail with a limited range of rotation permitted.

According to a third aspect of the present disclosure, there is provided a method of operating a thermal transfer printer, the method comprising:

advancing an inked ribbon past a printhead so as to allow ink to be removed from the inked ribbon by the printhead and transferred to a substrate during a printing operation;

supporting the printhead on a printhead carriage, wherein the printhead carriage is supported by a rail coupled to a body of the printer, and the rail extends along a direction parallel to a direction of travel of the inked ribbon;

moving the printhead towards the substrate; and aligning the printhead with the substrate comprising rotating the printhead around the rail.

Rotating the printhead around the rail may comprise rotating the printhead within a limited range of permitted rotation.

The method may further comprise rotating the printhead carriage around the rail with a limited range of rotation permitted so as to align the printhead with a printing platen supporting the substrate.

The method may further comprise: moving the printhead carriage and the printhead linearly along the rail during a printing operation when the printhead is pressed against the substrate.

According to a fourth aspect of the present disclosure, there is provided a thermal transfer printer comprising:

a printhead;

a tape drive configured to cause an inked ribbon to be advanced past the printhead so as to allow ink to be removed from the inked ribbon by the printhead and transferred to a substrate during a printing operation;

a printhead carriage on which the printhead is mounted, wherein the printhead carriage is rotatably coupled to a body of the printer; and a printhead in/out drive assembly configured to move the printhead towards and away from the substrate, wherein the printhead in/out drive assembly is supported by the printhead carriage such that the printhead carriage, the printhead and the printhead in/out drive assembly are configured to rotate simultaneously relative to the body of the printer.

The printhead carriage may be rotatably coupled to the body of the printer with a limited range of rotation permitted.

The rotation of the printhead carriage, the printhead and the printhead in/out drive assembly may be around a rail coupled to the body of the printer.

The printhead carriage, the printhead and the printhead in/out drive assembly may also be configured to move simultaneously in a linear fashion relative to the body of the printer.

The linear motion of the printhead carriage, the printhead and the printhead in/out drive assembly may be along the rail.

According to a fifth aspect of the present disclosure, there is provided a thermal transfer printer comprising:

a printhead;

a tape drive configured to cause an inked ribbon to be advanced past the printhead so as to allow ink to be removed from the inked ribbon by the printhead and transferred to a substrate during a printing operation; and a printhead carriage on which the printhead is mounted, wherein the printhead carriage is rotatably coupled to a body of the printer with a limited range of rotation permitted.

According to a sixth aspect of the present disclosure, there is provided a thermal transfer printer comprising:

a printhead;

a tape drive configured to cause an inked ribbon to be advanced past the printhead so as to allow ink to be removed from the inked ribbon by the printhead and transferred to a substrate during printing operations, wherein: the tape drive comprises a take-up spool support for supporting a spool core onto which inked ribbon can be wound to form a take-up spool, and the take-up spool support is configured to permit a supported spool core to rotate about a rotation axis extending substantially perpendicular from a body of the printer;

a printhead carriage, the printhead being mounted on the printhead carriage;

a printhead carriage drive assembly configured to drive the printhead carriage; and a drive housing, the drive housing configured to house the printhead carriage drive assembly, wherein the drive housing is securable to the body of the printer.

The drive housing may be removably secured to the body of the printer. The drive housing may be securable to the body of the printer by retaining clips.

According to a seventh aspect of the present disclosure, there is provided a thermal transfer printer comprising:

a printhead;

a tape drive configured to cause an inked ribbon to be advanced past the printhead so as to allow ink to be removed from the inked ribbon by the printhead and transferred to a substrate during printing operations, wherein: the tape drive comprises a take-up spool support for supporting a spool core onto which inked ribbon can be wound to form a take-up spool, and the take-up spool support is configured to permit a supported spool core to rotate about a rotation axis extending substantially perpendicular from a body of the printer;

a supply spool support; and a user interface provided on a user interface surface of a user interface housing;

wherein the body of the printer defines a substantially planar surface extending perpendicular to the rotation axis in a base plate plane;

wherein the take-up spool support extends in a first direction away from the base plate plane, and the supply spool support extends in the first direction away from the base plate plane; and wherein the user interface housing extends in the first direction away from the base plate plane.

Where appropriate any of the optional features described above in relation to the first aspect of the present disclosure may be applied to other aspects of the disclosure.

It would also be understood that the terms "first", "second", "third" and "fourth" are simply used in the present disclosure to label the relevant elements (e.g., "structure", "part", "direction" etc.) for the ease of description, and do not imply any limitations to the sequence or locations of the relevant elements.

BRIEF DESCRIPTION OF THE DRAWINGS

In order that the disclosure may be more fully understood, a number of embodiments of the disclosure will now be described, by way of example, with reference to the accompanying drawings, in which.

In the figures, like parts are denoted by like reference numerals.

It will be appreciated that the drawings are for illustration purposes only and are not drawn to scale.

DETAILED DESCRIPTION OF THE PREFERRED EMBODIMENTS

Figure 1:
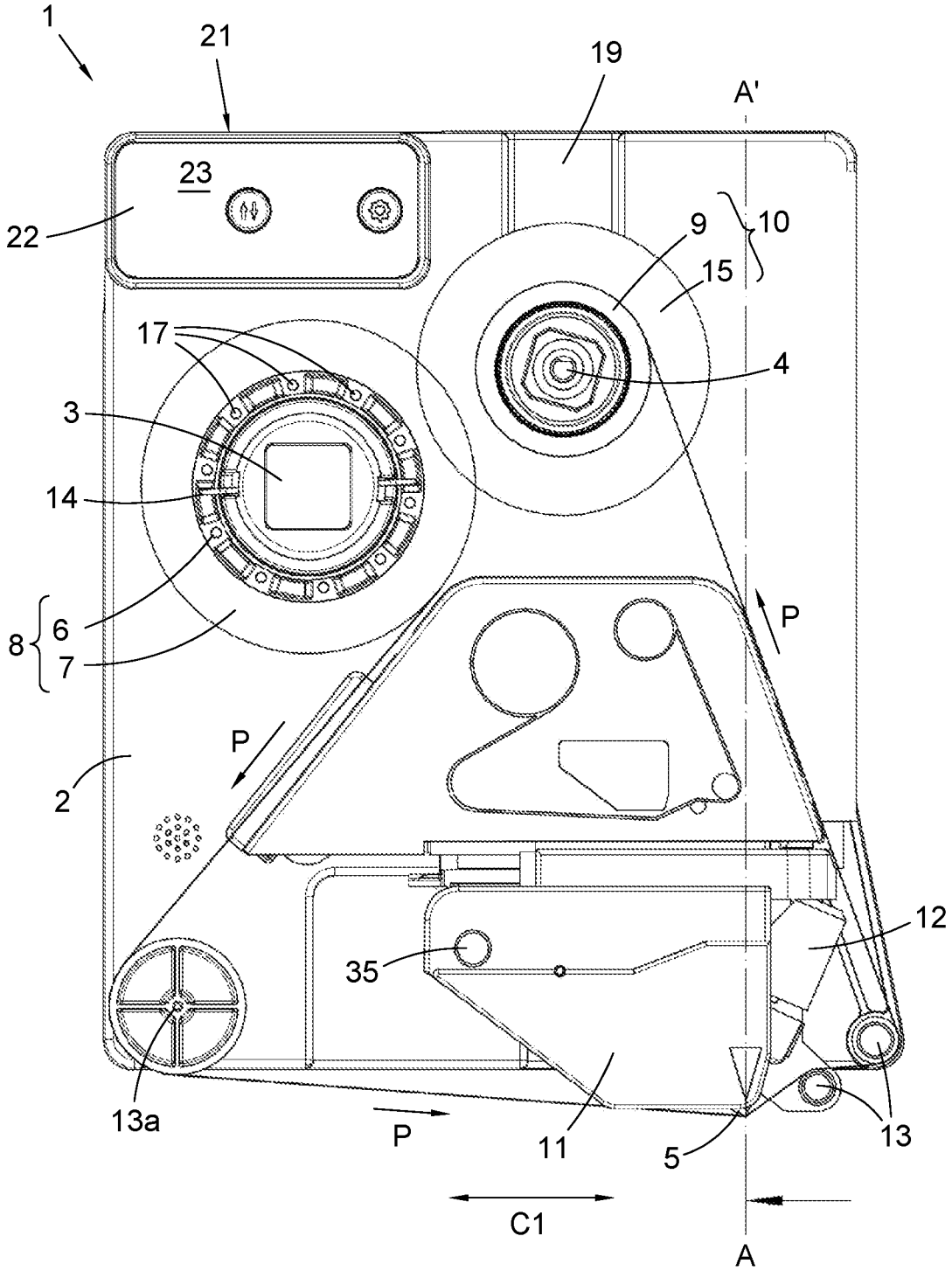
FIG. 1 is a schematic front illustration of a printer in accordance with the present disclosure.

Referring to FIG. 1, there is illustrated a thermal transfer printer 1 having a base plate 2, a supply spool support 3, take-up spool support 4 and a printhead 5. The base plate 2 may, for example, be formed from die-cast metal or moulded plastic. The term 'base plate' may be used to refer to the main component of the body of the printer. Thus, the terms "body" and "base plate" are used interchangeably in the present disclosure. The base plate 2 may be considered to form part of a housing of the printer 1. The printer housing houses various components of the printer including a printed circuit board and motors which are described below in more detail.

The terms 'proximal' and 'distal' are used within this specification. The term 'distal' relates to a direction pointing towards the base plate 2 and the term 'proximal' relates to a direction pointing away from the base plate 2.

The supply spool support 3 extends from and is rotationally fixed to the base plate 2 (e.g. cannot rotate relative to the base plate 2). In contrast, the take-up spool support 4 is rotatable relative to the base plate 2, driven by a motor (not shown). The supply spool support 3 is arranged to support a ribbon supply spool core 6, upon which is wound ink carrying ribbon 7. The supply spool core 6 and any ribbon 7 wound thereon may be referred to as a supply spool 8. While the supply spool support 3 is fixed with respect to the base, the supply spool 8 is able to rotate about the supply spool support 3 when the friction between the supply spool 8 and the supply spool support 3 is overcome. The supply spool support 3 comprises a spring 14 for retaining the ribbon supply spool 8 on the supply spool support 3. Alternatively, the supply spool support 3 may also be rotatable relative to the base plate 2, driven by, for example, another motor. In this way, the printer 1 may apply more sophisticated control of the ribbon tension between the supply spool support 3 and the take-up spool support 4.

The take-up spool support 4 is arranged to support a ribbon take-up spool core 9, upon which used ink ribbon 15 is wound following printing. The take-up spool core 9 and the used ink ribbon 15 wound thereon may be referred to as a take-up spool 10. The take-up spool support 4 comprises a retaining means (not shown) for retaining the take-up spool 10 on the take-up spool support 4. This may comprise, for example, a flat spring located on a circumferential surface of the take-up spool support 4, and which projects radially outward when relaxed, and grips an inner circumferential surface of the ribbon take-up spool core 9 when the ribbon take-up spool core 9 is installed on the take-up spool support 4. The proximal end 4*a* (shown in FIG. 4) of the take-up spool support 4 comprises a knurled section for winding ribbon by hand, such as when webbing up with new ink ribbon 7.

When the motor coupled to the take-up spool support 4 causes the take-up spool support 4 to rotate in the anti-clockwise direction, the ribbon 7 is unwound from the supply spool 8, causing the supply spool 8 to rotate clockwise. The ribbon 7 travels along a ribbon path P past the printhead 5, and is wound on to the take-up spool 10. There may be one or more rollers 13 in the ribbon path P which are used to help guide the ribbon 7. One of the rollers 13*a* may be a sticky roller, which may have an encoder for determining ribbon speed. The motor, the take-up spool support 4, and the supply spool support 3 may be collectively referred to as a 'tape drive' of the printer 1.

In an embodiment, the rotation of the supply spool 8 is monitored by a sensor 62 (shown in FIG. 2) mounted within the base plate 2. The sensor 62 senses periodic features 17 of the supply spool core 6, and generates a sensor signal indicative of rotation of the supply spool 8. For example the sensor signal may comprise a plurality of pulses, each pulse indicating that a predetermined angular rotation has taken place. For example, if thirty-six periodic features 17 are evenly distributed around the internal surface of the spool core 6 and a pulse is generated as each of the periodic features 17 passes the sensor 62, each pulse will indicate that the spool core 6 has rotated by ten degrees. In the example shown in FIG. 1, the periodic features 17 are in the form of ten castellations (not all periodic features are labelled in the figure for clarity).

Figure 4:
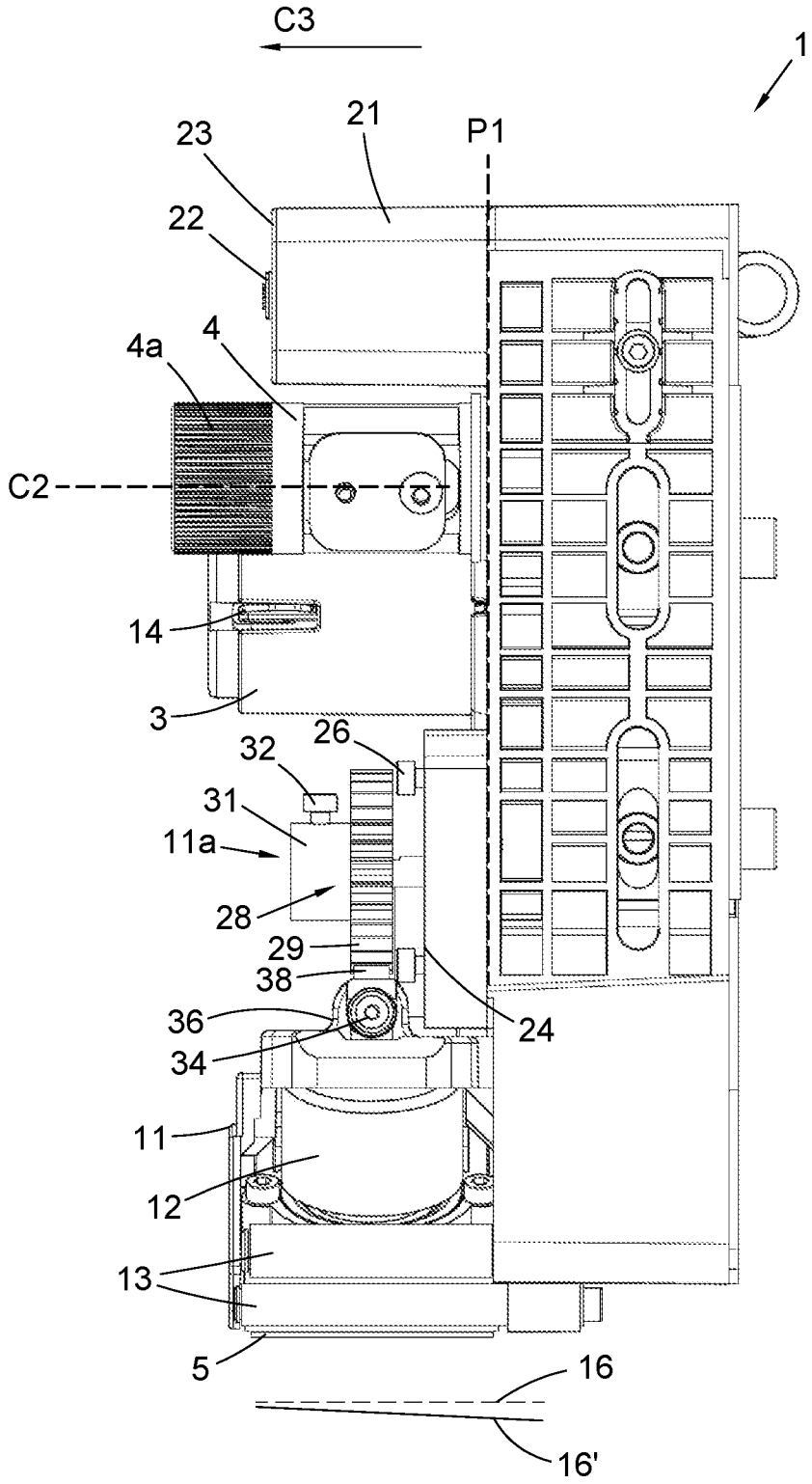
FIG. 4 shows a side view of the printer of FIG. 2 when a printhead carriage of the printer is in a vertical orientation.

The printhead 5 may be any suitable printhead for use in a thermal printer. In an embodiment, the printhead 5 comprises a printhead ceramic upon which printing elements are arranged in a one-dimensional linear array (FIG. 4). The one-dimensional linear array generally extends along a direction that is perpendicular to the two-dimensional plane of FIG. 1. The printhead 5 further comprises a heatsink, to which the printhead ceramic is attached. The printhead 5 is mounted in a printhead carriage 11 which may move linearly, back and forth, along an axis C1 substantially parallel to the direction of travel of the ribbon 7 in an intermittent mode as described below. During printing, ink carried on the ribbon 7 is transferred to a substrate (not shown) which is to be printed on. The substrate is typically supported by a printing platen (not shown). To cause the transfer of ink, the printhead 5 is brought into contact with and pressed against the ribbon 7 and the substrate. The printhead 5 is further mounted on a support arm (not shown) which pivots about a pivot 35. The pivotal axis of the printhead 5 is along a direction that is perpendicular to the two-dimensional plane of FIG. 1. The arc of movement of the printhead 5 with respect to the pivot 35 is determined by the location of the printhead 5 relative to the pivot 35, which is, in turn, determined by the length of the support arm. Movement of the printhead 5 towards and away from the substrate and the printing platen is controlled by a printhead in/out drive assembly 12 as described in more detail below. The support arm, the pivot 35 and the printhead in/out drive assembly 12 are all mounted in the printhead carriage 11, and therefore are moveable (e.g., sliding and/or rotating) together with the printhead carriage 11 with respect to a rail 34 (described below).

The printhead in/out drive assembly 12 may be an electromagnetic or pneumatic drive unit. In an example, the printhead in/out drive assembly 12 may comprise an electro-permanent magnet system as described in PCT/EP2017/084503, which is hereby incorporated by reference. In an alternative example, the printhead in/out drive assembly 12 may comprise a resilient biasing member (e.g., a coil spring) and an electromagnet (e.g., a solenoid) which exert forces of opposition directions on the printhead 5.

However, it will be appreciated that the printhead in/out drive assembly 12 may take any suitable form. During activation of the in/out drive assembly 12, the ribbon 7 is also brought into contact with the substrate (not shown) to be printed on. The printing elements, when heated, whilst in contact with the ribbon 7, cause ink to be transferred from the ribbon 7 and onto the substrate to be printed on. Ink will be transferred from regions of the ribbon 7 which correspond to (i.e. are aligned with) printing elements which are heated. The array of printing elements can be used to perform printing of an image on to the substrate by selectively heating printing elements which correspond to regions of the image which require ink to be transferred, and not heating printing elements which require no ink to be transferred. Printing a single row of dots on the substrate, perpendicular to the direction of travel of the printhead 5, is sometimes referred to as a printing operation.

The operation of the printer 1 is controlled by a controller (not shown), which is provided on a printed circuit board (not shown). The printed circuit board may be mounted on the reverse side of the base plate 2. It will be appreciated that the controller may alternatively be located elsewhere and coupled to the printer 1 via a wired or wireless connection. The controller can take any suitable form, including ASICs, FPGAs, or microcontrollers which read and execute instructions stored in a memory to which the controller is connected.

Figure 2:
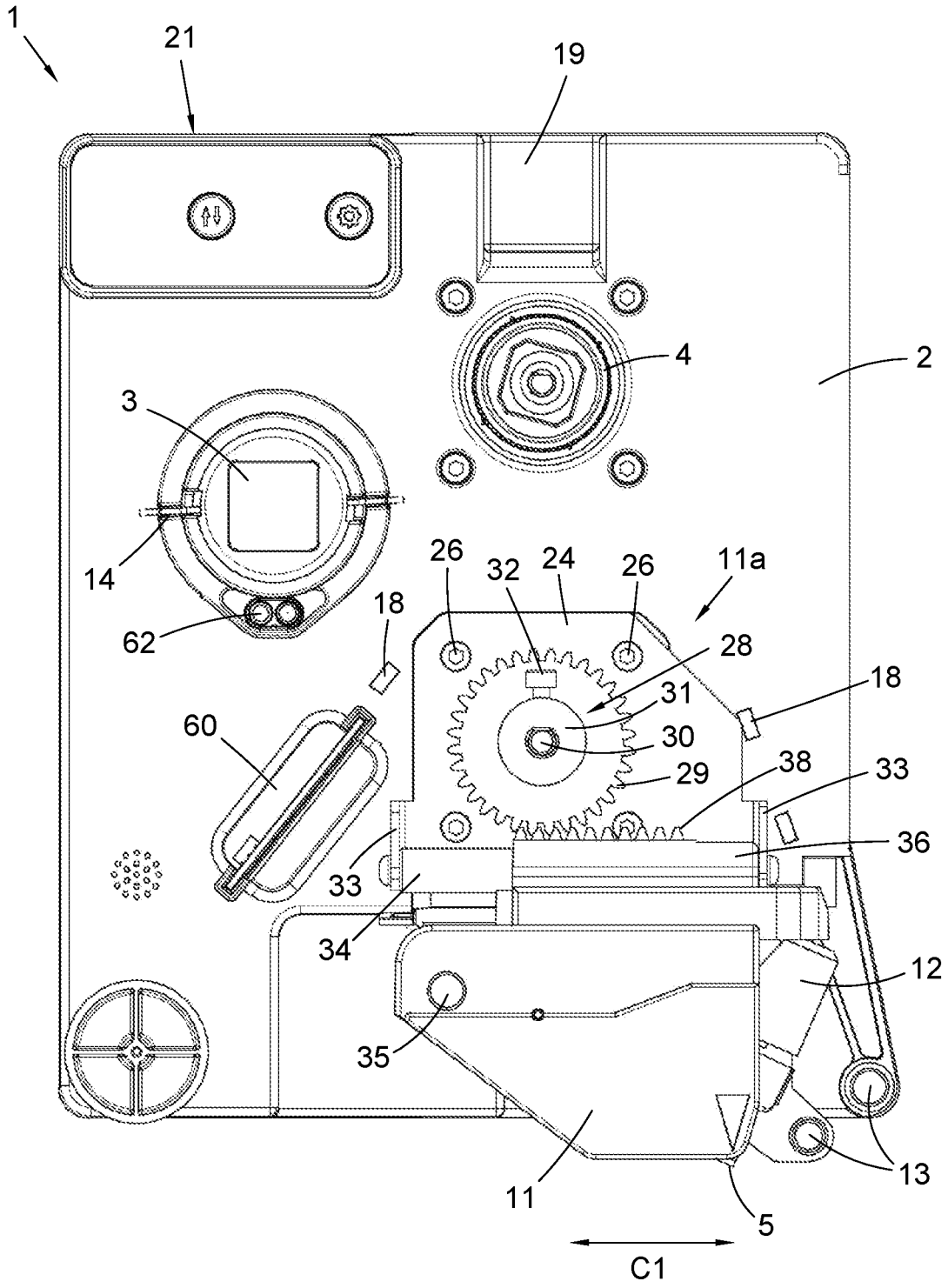
FIGS. 2 and 3 are schematic front illustrations of the printer of FIG. 1 where a printhead drive housing, a supply spool 8, a take-up spool 10, and a flexible ribbon cable are not shown.
Figure 3:
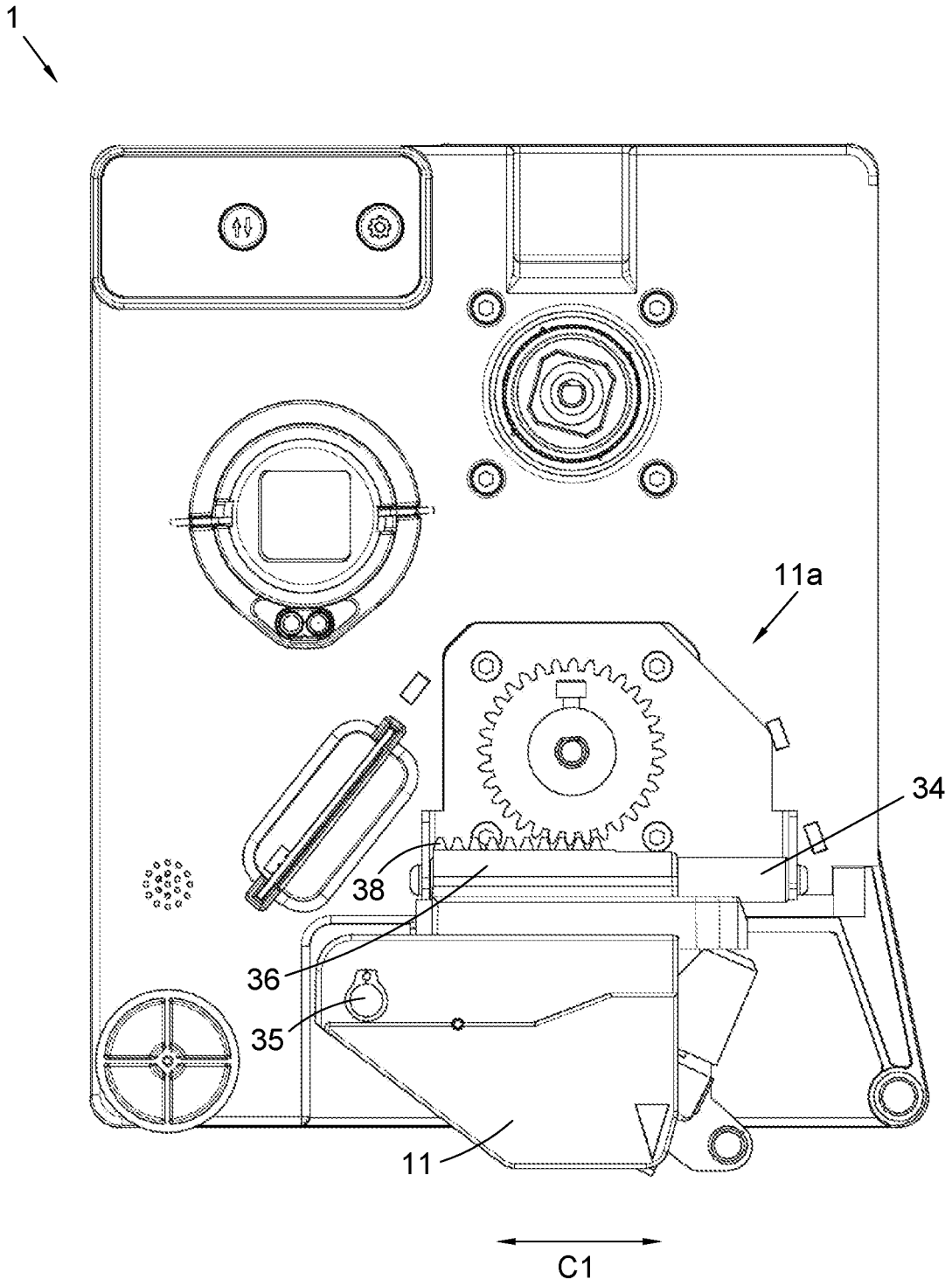

The printer 1 further includes a printhead drive housing 20 (referred to as "drive housing" below), which houses a printhead carriage drive assembly 11*a* (shown in FIGS. 2 to 4 and described below) for the printhead carriage 11. The drive housing 20 may be formed as a molded plastic part having retaining clips which secure the drive housing 20 to the base plate 2. The retaining clips may be configured to co-operate with apertures 18 (FIG. 2) provided in the base plate 2. It will be appreciated that the drive housing 20 may be securable to the base plate 2 in any suitable manner. It is preferable that the drive housing 30 is removably securable to the base plate 2. In this way, the drive housing 20, when secured to the base plate 2 to cover the printhead carriage drive assembly 11*a*, acts as a safety measure for a user, and also allows the user to easily maintain the printhead carriage drive assembly 11*a* by removing the drive housing 20. FIGS. 2 and 3 show front views of the printer 1 when the drive housing 20, the supply spool 8, the take-up spool 10, and a flexible ribbon cable electrically connecting the printhead 5 and a printer connector 60 formed on the base plate 2 are removed. In use, the printhead carriage drive assembly 11*a* and the printer connector 60 are obscured from view in FIG. 1 by the drive housing 20. FIG. 4 shows a side view of the printer 1, looking from the right-hand side of the printer 1 as shown in FIG. 2.

The base plate 2 may define one or more generally planar surfaces from which various other components of the printer may extend. The one or more generally planar surfaces may be parallel to one another. As shown in FIG. 4, the generally planar surface(s) of the base plate 2 define a base plate plane P1. The take-up spool support 4 is configured to cause the take-up spool core 9 to rotate about a rotation axis C2 (FIG. 4). The rotation axis C2 is generally parallel to the axis of the printhead pivot 35 as described above. The base plate 2 further comprises a user interface housing 21 (FIGS. 1 and 4) which provides a user interface 22 at a front surface 23. The user interface housing 21 protrudes from the base plate plane P1. The front surface 23 may be considered to be a surface which is facing a user when looking at a printer from the orientation shown in FIGS. 1 to 3. The user interface 22 may, for example, comprise various buttons and indicators which allow the user to interact with printer 1. Various components of the printer 1 may be integrally formed with the base plate 2 such that they can be made from a single plastic moulding. For example, the user interface housing 21 and/or the supply spool support 3 may be integrally formed with the base plate 2. As further shown in FIG. 4, each of the supply spool support 3, the take-up spool support 4 and the user interface housing 21 extends along a direction C3 away from the body 2 of the printer. The direction C3 is generally perpendicular to the base plate plane P1 and parallel to the rotation axis C2.

The base plate 2 further comprises a recessed region 19 provided adjacent to the take-up spool support 4. The recessed region 19 is recessed from the base plate plane P1 in a direction opposite to C3. The recessed region 19 is provided to enable a user to remove the used ribbon 15 safely and conveniently. For example, the recessed region 19 may be configured to permit the user to easily access an inner side of the used ribbon 15 facing the base plate 2. This allows the user to grip the inner side of the used ribbon 15, and also to grip an opposite outer side of the ribbon 15 or the spool core 9, and to easily remove the take-up spool 10.

There are generally two modes in which thermal transfer printers can be used, which are sometimes referred to as a "continuous" mode and an "intermittent" mode. In both modes of operation, the apparatus performs a regularly repeated series of printing cycles, each cycle including a printing phase during which ink is transferred to a substrate, and a further non-printing phase during which the printer is prepared for the printing phase of the next cycle.

In continuous printing, during the printing phase the printhead 5 is brought into contact with the ribbon 7, the other side of which is in contact with a substrate onto which an image is to be printed. The printhead 5 is held stationary during this process. The term "stationary" is used in the context of continuous printing to indicate that although the printhead 5 will be moved into and out of contact with the ribbon 7, it will not move relative to the ribbon path in the direction in which ribbon 7 is advanced along that path. Both the substrate and ribbon 7 are transported past the printhead 5 generally, but not necessarily, at the same speed.

In intermittent printing, a substrate is advanced past the printhead 5 in a stepwise manner such that during the printing phase of each cycle the substrate and generally but not necessarily the ribbon 7 are stationary. Relative movement between the substrate, the ribbon 7 and the printhead 5 are achieved by displacing the printhead 5 relative to the substrate and ribbon along axis C1. During each printing phase, the printhead carriage 11 moves along a length (along the axis C1) of the substrate so that the printhead 5 may print along the length of the substrate. That is, a number of printing operations are carried out while the substrate to be printed on is stationary. A total number of printing operations carried out as the printhead carriage 11 moves along the length of the substrate is sometimes referred to as a printing stroke, where carrying out a printing stroke leads to a plurality of rows of dots being printed on the substrate as the printhead carriage 11 moves along the length of the substrate. Between the printing phases of successive cycles, the substrate is advanced so as to present the next region to be printed beneath the print head 5 and the ribbon 7 is advanced so that an unused section of ribbon is located between the printhead 5 and the substrate. Accurate transport of the ribbon 7 is, therefore, necessary to ensure that unused ribbon is always located between the substrate and printhead 5 at a time that the printhead 5 is caused to conduct a printing operation.

The printer 1 is generally used in intermittent mode, but can also be used in continuous mode. Where the intermittent mode is used, the printhead carriage 11 (and the printhead 5 mounted thereon) is caused to move along a length (along the axis C1) of the substrate so as to allow its displacement along the ribbon path P. FIGS. 2 and 3 illustrate the end points of the linear motion of the printhead carriage 11. This linear motion of the printhead carriage 11 is caused by the printhead carriage drive assembly 11*a*.

As described above, a motor (not shown) is provided for driving the take-up spool support 4 so as to advance the ink ribbon 7 between the ribbon supply spool 8 and the ribbon take-up spool 10. The printhead carriage drive assembly 11 a uses a second, different, motor (which has an output shaft 30 shown in FIG. 2) to cause the linear movement of the printhead carriage 11 during printing. Both motors may be any suitable motors such as, for example, stepper motors. The output shaft 30 of the second motor extends through the base plate 2 and a support plate 24. The support plate 24 is secured to the base plate 2 by bolts 26. The bolts 26 may also be used to secure the second motor to the backside of the base plate 2. The support plate 24 defines a generally planar surface which is parallel to the base plate plane P1 as shown in FIG. 4. The support plate 24 further comprises a pair of brackets 33 located at two opposite sides of the generally planar surface. The pair of brackets 33 extend away from the generally planar surface of the support plate 24 along a direction which is perpendicular to the base plate plane P1. A rail 34 extends between the pair of brackets 33 along a direction which is parallel to the axis C1 (which is further parallel to the direction of travel of the ribbon 7). The rail 34 has a cylindrical shape and may be coupled to the brackets 33 at its two ends by suitable fixtures such as screws.

Alternatively, the rail 34 may be integrally formed with the brackets 33. The support plate 24 may be made of metal.

Figure 5:
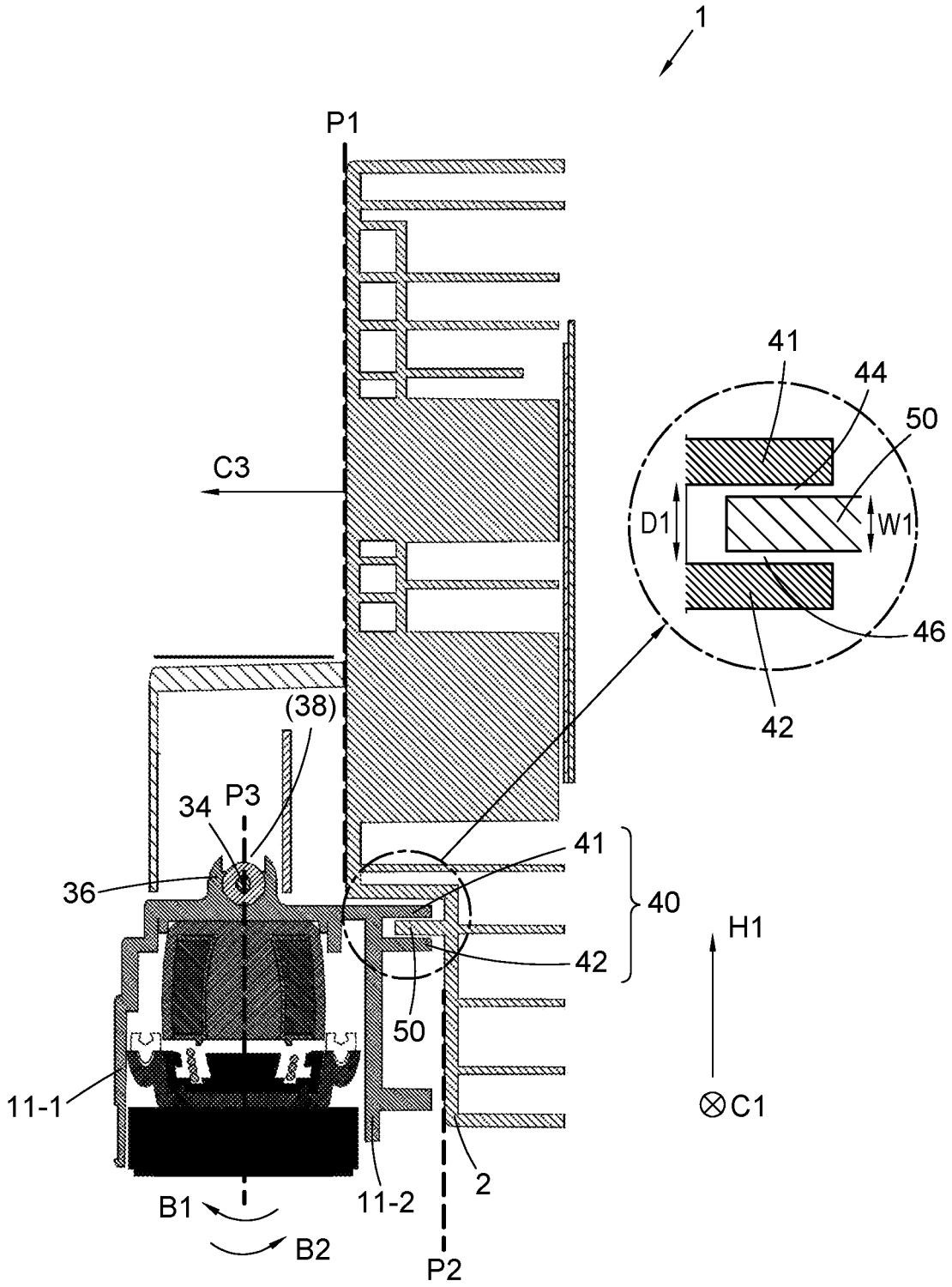
FIG. 5 shows a cross-sectional side view of the printer of FIG. 1 when the printer is cut along line A-A'.

With further reference to FIGS. 2 to 4, the printhead carriage 11 comprises a guide structure 36 at its upper side, while the printhead 5 is generally located at the lower side of the printhead carriage 11. The guide structure 36 is configured to moveably engage with the rail 34. In the example shown by FIGS. 2 to 4, the guide structure 36 is generally of a tubular shape and comprises a central bore. As shown in FIG. 5 which is described below in more detail, it can be seen that the central bore is not fully enclosed at the top end of the guide structure. The rail 34 passes through the central bore of the guide structure 36 so as to support the entire printhead carriage 11. It would be appreciated that the guide structure 36 may take any suitable form as along as it allows the print carriage 11 to move (e.g., slide and/or rotate) with respect to the rail 36. The rail 34 may be made of metal (e.g. aluminium), and the printhead carriage 11 may be made of a low friction plastic material (e.g. acetal). It would be understood that a small clearance is preferably provided between the central bore of the guide structure 36 and the rail 34, so as to allow ease of movement (either sliding or rotation) of the guide structure 36 with respect to the rail 34.

The printhead carriage drive assembly 11 a comprises a circular gear 28. The printhead carriage 11 further comprises a gear rack 38 (also known as a linear gear rack) which engages with the circular gear 28 such that rotation of the circular gear 28 causes linear motion of the printhead carriage 11 along the rail 34. The gear rack 38 and the circular gear 28 may also be referred to as a rack and pinion arrangement. In the example shown by FIGS. 2 to 4, the gear rack 38 is formed on the upper surface of the guide structure 36. However, it will be appreciated that the gear rack 38 may be placed at any suitable location on the printhead carriage 11 depending upon the particular design of the printhead carriage 11. The circular gear 28 comprises a central hub 31 out of which extend teeth 29 of the circular gear 28 for engaging with the gear rack 38. In an example, the circular gear 28 may be a spur gear. With reference to FIG. 4, the central hub 31 has a greater length than the teeth 29 along the direction C3, and a part of the central hub 31 which extends beyond the length of the teeth 29 is fixedly connected to the output shaft 30 of the motor by a fastener 32. The fastener 32 may take any suitable form (such as, for example, a nut and a bolt or a screw). In this way, a rotation of the output shaft 30 of the motor causes a corresponding rotation of the circular gear 28, which in turn causes a linear movement of the printhead carriage 11 along the rail 34.

FIG. 2 shows the printhead carriage 11 at the right end of the rail 34, and FIG. 3 shows the printhead carriage 11 at the left end of the rail 34. During each printing phase in the intermittent mode, the printhead carriage 11 moves between the position shown in FIG. 2 and another position to the left of the position shown in FIG. 2. FIG. 3 shows the maximum movement of the printhead carriage so the distance between the carriage positions of FIGS. 2 and 3 determines the longest image that can be printed. The circular gear 28 may be made of any suitable material (such as metal or plastics). The gear rack 38 may be made of the same material (such as, a low friction plastic material) as the rest of the printhead carriage 11, or alternatively may be made of a different material. Exposing the circular gear 28 and the gear rack 38 may cause injuries to a user operating the printer 1. For example, the user's finger may be accidentally trapped between the circular gear 28 and the gear rack 38. Therefore, by covering the printhead carriage drive assembly 11 a, the drive housing 20 acts as a safety measure and is useful to protect the user.

As described above, the printhead 5 comprises printing elements which are arranged in a one-dimensional linear array. The one-dimensional linear array can be clearly seen in FIG. 4. Typically, the one-dimensional linear array extends along a direction which is parallel to the direction C3 and perpendicular to the base plate plane P1. When a substrate to be printed upon extends along a direction 16 which is strictly parallel to the one-dimensional linear array in the side view of FIG. 4, it would be understood that when the printhead is driven out into its printing position against the substrate, uniform pressures would be established between the printing elements and the substrate across the length of the printhead 5. However, in practice strict alignments between the substrate and the printhead 5 may be difficult to achieve. For example, the printing platen supporting the substrate may be positioned in a slightly tilted manner with respect to the printhead 5, and/or the substrate may have inclined surfaces. For example, when the surface of the substrate extends along a direction 16' which is not parallel to the one-dimensional linear array, the print quality may deteriorate because of over-pressure on one side and under-pressure on the other side of the array of printing elements and the substrate. Under pressure can cause light print while over pressure can cause ribbon creasing, print defects or even damage the substrate which is being printed on.

To solve this problem, the printhead carriage 11 is able to rotate about the axis of the rail 34 so that the print force provided by the printhead in/out drive assembly 12 causes the printhead 5 to align with the misaligned substrate 16'. To prevent the printhead carriage 11 from rotating excessively about the axis of the rail 34, causing difficulty fitting ribbon 7 for example, the printhead carriage 11 comprises a first structure 40 (FIG. 5) coupled to its inner surface 11-2 facing the base plate 2. FIG. 5 shows a cross-sectional side view of the printer 1 when the printer 1 is cut along a line A-A' shown in FIG. 1. The printhead carriage 11 also has an outer surface 11-1 opposite to the inner surface 11-2. With further reference to FIG. 5, the first structure 40 engages with a second structure 50 coupled to the base plate 2. In the cross-sectional view of FIG. 5, it can be seen that the base plate 2 defines two generally planar surfaces which respectively extend along the base plate plane P1 (also referred to as "a first base plate plane"), and a second base plate plane P2 which is parallel to P1. The second base plate plane P2 is recessed from the first base plate plane P1, and the second structure 50 is coupled to the second base plate plane P2. In the example of FIG. 5, the first structure 40 comprises a first part 41 and a second part 42 provided at either side of the second structure 50, and each of the first part 41, the second part 42, and the second structure 50 extends along a direction parallel to the axis C1. In this way, the first structure 40 is able to slide linearly with respect to the second structure 50 during a linear motion of the printhead carriage 11 with respect to the base plate 2.

As shown in the inset of FIG. 5, a distance D1 between the first part 41 and the second part 42 is greater than a width W1 of the second structure 50 along a vertical direction H1 (which is perpendicular to the axis C1 and parallel to the base plate plane P2). When the printhead carriage 11 is orientated at a vertical, neutral, position as shown in FIG. 5, a gap 44 is provided between the first part 41 and the second structure 50, and a gap 46 is provided between the second part 42 and the second structure 50. The neutral position refers to an untilted position of the printhead carriage 11 in which the one-dimensional linear array of printing elements extend along the direction C3 perpendicular to the base plate plane P2.

Figure 6:
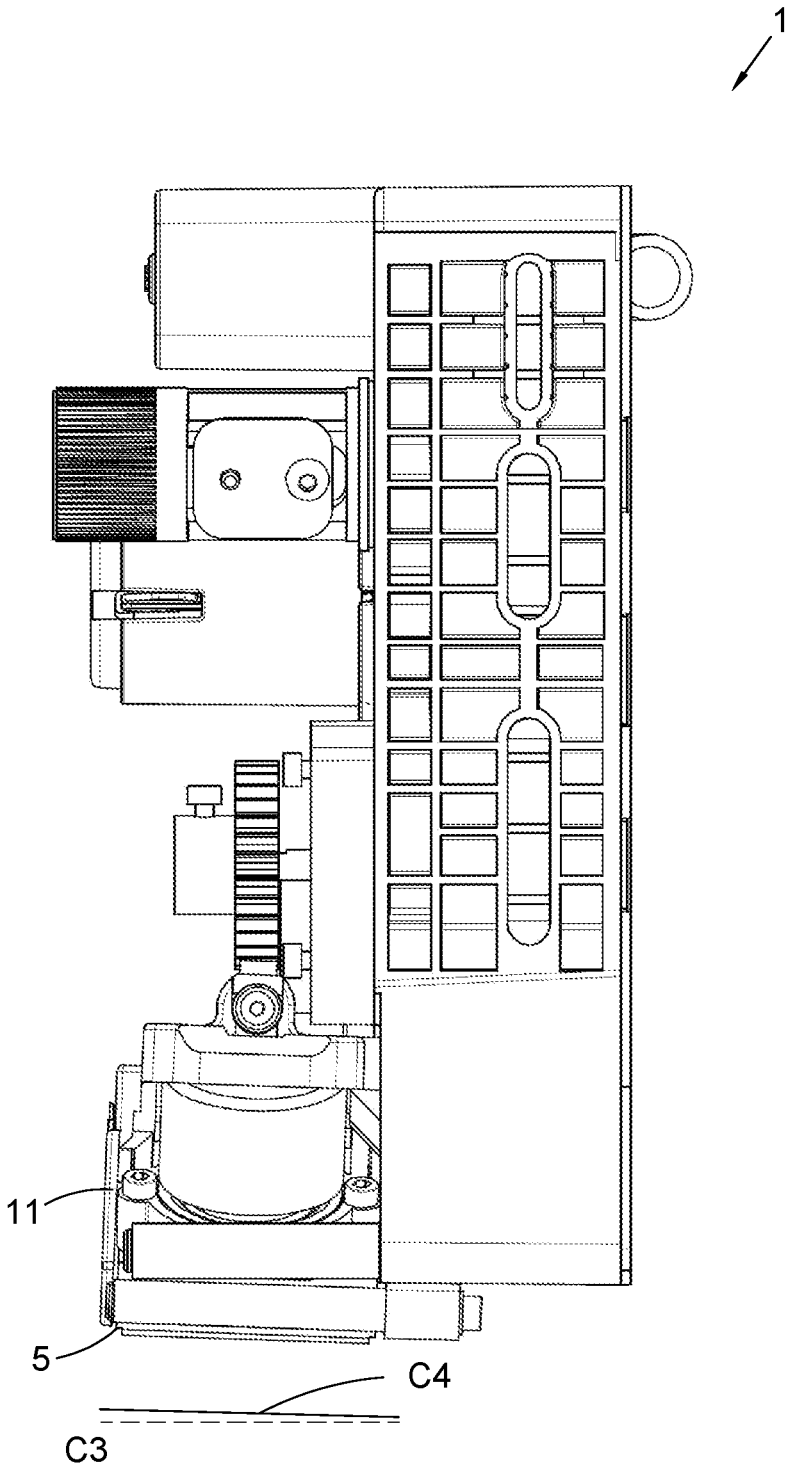
FIGS. 6 and 7 show side views of the printer of FIG. 2 when the printhead carriage of the printer pivots away from the vertical orientation.

The gap 44 allows the printhead carriage 11 to rotate around the rail 34 in a clockwise direction B1 away from the base plate 2, through a limited angular range from the neutral position. When the first part 41 abuts against the upper surface of the second structure 50, the printhead carriage 11 reaches the limit of the allowable rotational range and cannot rotate further in the direction B1. FIG. 6 shows the orientation of the printhead carriage 11 at the limit of the rotational range in the direction B1. In FIG. 6, the printing elements of the printhead 5 extend along a direction C4 which is tilted from the direction C3 (perpendicular to the base plate plane P1/P2).

Figure 7:
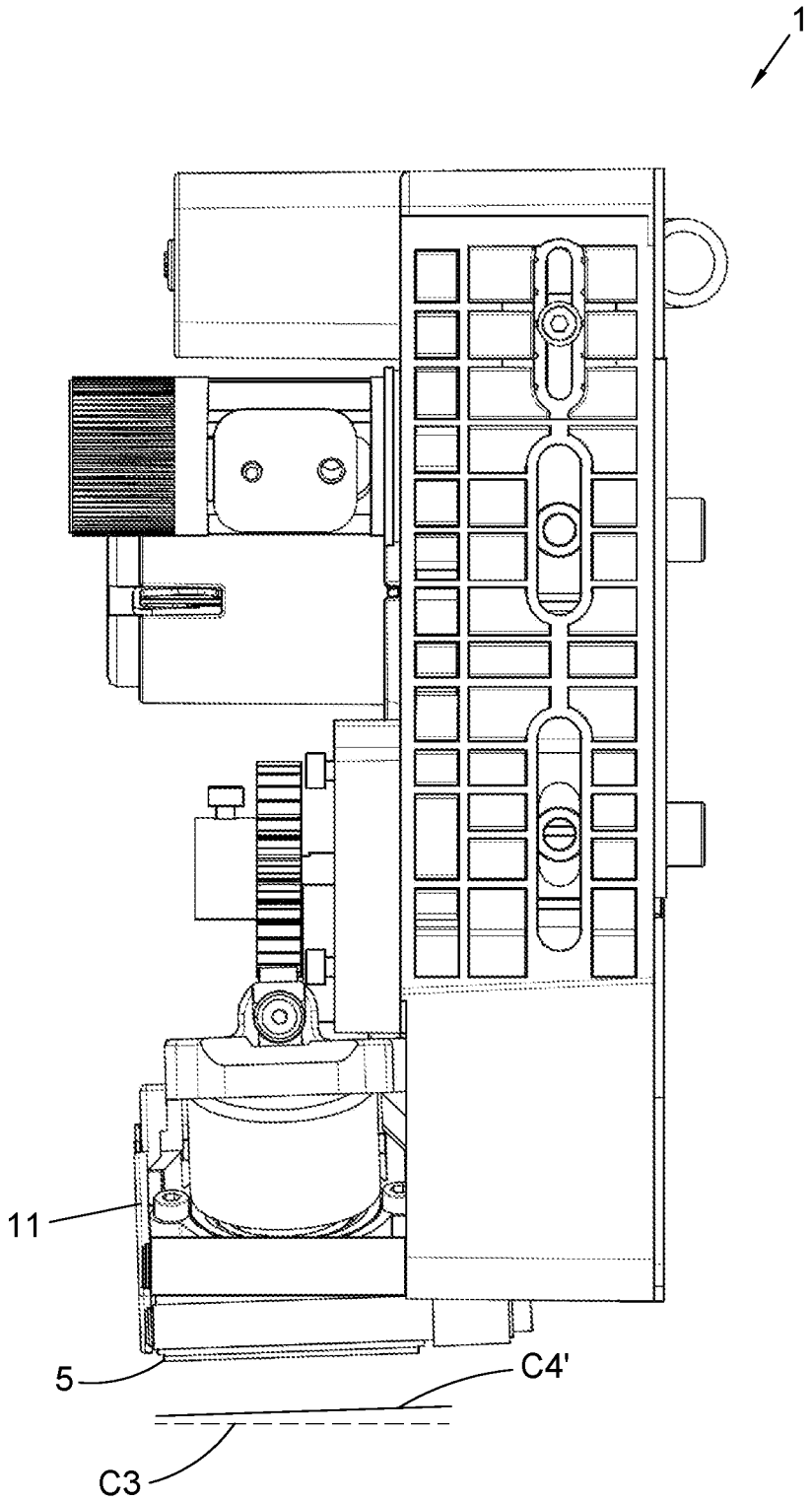

Similarly, the gap 46 allows the printhead carriage 11 to rotate around the rail 34 in an anti-clockwise direction B2 towards the base plate 2, through a limited angular range from the neutral position. When the second part 42 abuts against the lower surface of the second structure 50, the printhead carriage 11 reaches the limit of the allowable rotational range and cannot rotate further in the direction B2. FIG. 7 shows the orientation of the printhead carriage 11 at the limit of the rotational range in the direction B2. In FIG. 7, the printing elements of the printhead 5 extend along a direction C4' which is tilted from the direction C3 in an opposite direction as compared to C4.

In the example of FIG. 5, the gaps 44 and 46 have identical widths along the vertical direction H1, such that the allowable rotational ranges in the directions B1 and B2 from the neutral positon are identical to one another. For example, the allowable rotational ranges may be 1 degree in either direction, achieving a 2-degree combined rotatable range.

It will be understood that by changing the widths of the gaps 44 and 46, the rotational ranges of the printhead carriage 11 in the directions B1 and B2 from the neutral positon may be easily adjusted. Further, the printer 1 may be modified such that the printhead carriage 11 is only allowed to rotate in one of the directions B1 and B2 from the neutral position. In any event, the total rotatable range of the printhead carriage 11 may be at least approximately 0.25 degree, and may not exceed approximately 5 degrees.

By providing the guide structure 36, the rail 34, the first structure 40 and the second structure 50, the printhead carriage 11 is able to adjust its orientation with respect to the surface of the substrate, so as to allow the printhead 5 mounted on the printhead carriage 11 to align with the surface of the substrate. In this way, uniform pressures can be achieved between the printing elements of the printhead 5 and the substrate, thereby improving the printing quality regardless of the surface orientation of the substrate (at least within a range). The first structure 40 and the second structure 50 further restrict the rotation of the printhead carriage 11 to be within a limited range (e.g., from about 0.25 degree to 5 degrees). Consequently, the printhead carriage 11 cannot move far away from the neutral position (as shown in FIG. 5). Thus uniform contact between the printhead 5 and the substrate can be easily established and maintained during printing operations.

By using the rail 34 to support the printhead carriage 11, the printhead carriage 11 is able to move linearly relative to the body 2 of the printer 1 (along the rail 34) and also to tilt relative to the body 2 of the printer 1 (about the rail 34). Further, because the printhead 5 and the printhead in/out drive assembly 12 are mounted on the printhead carriage 11, the printhead 5 and the printhead in/out drive assembly 12 are also able to slide along and rotate around the rail 34 simultaneously with the printhead carriage 11. The rail 34 therefore allows two different motions of the printhead carriage 11 and the printhead 5 to take place at the same time, and greatly improves the mechanical simplicity of the printhead drive mechanism of the printer 1. In addition, the use of the rail 34 allows the printhead carriage 11 to be driven by the printhead carriage drive assembly 11 a in a reciprocating manner (along the rail 34). This is useful for the printer 1 to operate in an intermittent mode.

With reference to FIGS. 4 and 5, the rail 34 is located directly above the centre line of the printhead 5. This arrangement is beneficial in that a centre point of the array of printing elements will stay at approximately the same vertical position regardless of the rotational position of the carriage 11 around the axis of the rail 34, since the centre point is moving around the bottom of a circular arc, and thus a nominal print distance between the printer 1 and the substrate would not substantially change when the printhead carriage 11 pivots along the B1, B2 directions. The edges of the array of printing elements will however move up or down a bit more. Further, it is beneficial to keep the distance between the rail 34 and the printhead 5 to be relatively short. A shorter distance between the rail 34 and the printhead 5 means that the printhead 5 will move sideways less when the printhead carriage 11 pivots at the same angle.

With reference to FIGS. 4 and 5, the gear rack 38 is located directly above the centre line of the rail 34. Although the gear rack 38 is not visible in FIG. 5 because the section line A-A' of FIG. 1 does not pass through the gear rack 38, it can be seen in FIG. 4 that the gear rack 38 is located above the rail 34 so that both lie in a plane P3 which passes through the centre of the array of printing elements and is parallel to plane P1. Further as shown in FIG. 4, the teeth 29 of the circular gear 28 are directly above and aligned with the gear rack 38. This arrangement with both gears directly above the rail 34 is useful to ensure print quality because when driven, the gear teeth 29 produce a small downward component of force, and if this force is off centre relative to the rail 34, it would push down on one side of the printhead 5 more than the other side, which could negatively affect print quality. It would be understood that a small clearance is preferably provided between the teeth of the circular gear 28 and the teeth of the gear rack 38, so as to allow the gear rack 38 to easily rotate about the axis of the rail 34 together with the printhead carriage 11. Otherwise, the teeth of both gears may wear quickly in use.

Figure 8:
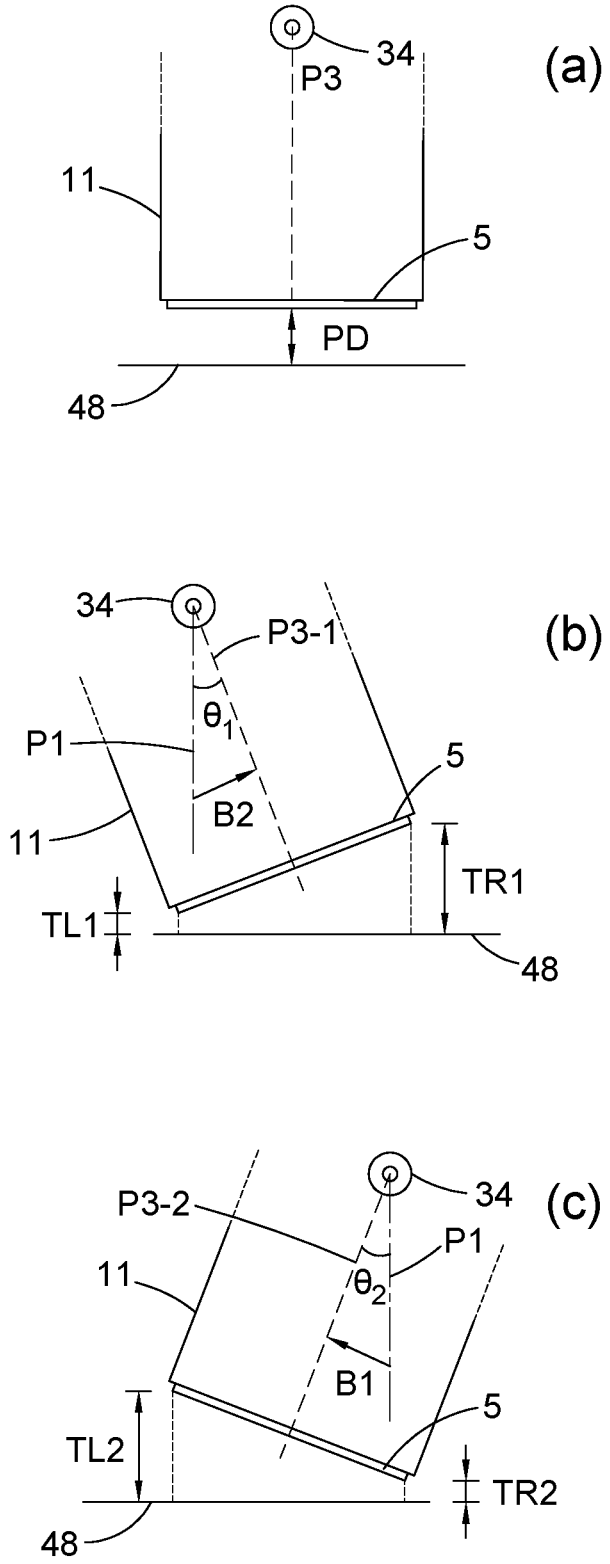
FIG. 8 shows orientations of a printhead of the printer of FIG. 1 with respect to a substrate to be printed on, (a) when the printhead carriage stays at a neutral position, (b) when the printhead carriage pivots towards a body of the printer, and (c) when the printhead carriage pivots away from the body of the printer.

As described above, the rotation of the printhead carriage 11 around the rail 34 is restricted to be within a limited range (e.g., from about 0.25 degree to about 5 degrees). Although the rotational range of the printhead carriage 11 appears small, the linear distances moved at the end of the printhead 5 could be significant as compared to the nominal print distance of the printer 1. FIG. 8(*a*) schematically shows a nominal print distance PD between the printhead 5 and a substrate 48 when the printhead 5 remains in the neutral position and the substrate 48 is aligned with the array of printing elements within the printhead 5. It will be understood that the substrate 48 extends along a plane that is perpendicular to the base plate plane P1/P2 and parallel to the axis C2/C3. This is the ideal, neutral, orientation of the substrate 48. As described above, when the printhead 5 remains in its neutral position, the centre plane P3 of the printhead 5 stays parallel to the base plate plane P1/P2. The printhead in/out drive assembly 12 needs to drive the printhead 5 towards the substrate 48 by the nominal print distance PD in order to perform printing. In an example, the nominal print distance PD is 2 millimetres (mm).

FIG. 8(*b*) schematically shows the orientation of the printhead 5 relative to the substrate 48, when the printhead carriage 11 rotates in the anti-clockwise direction B2 towards the base plate 2 by an angle θ1. At this time, the centre plane P3 of the printhead 5 rotates to a position indicated by P3-1. Due to the rotation of the printhead carriage 11, the printhead 5 does not align with the substrate 48. The left end of the printhead 5 is separated from the substrate 48 by a first linear distance TL1. The right end of the printhead 5 is separated from the substrate 48 by a second linear distance TR1 which is greater than TL1. A difference of TR1 and TL1 indicates an extent of misalignment between the printhead 5 and the substrate 48.

FIG. 8(*c*) schematically shows the orientation of the printhead 5 relative to the substrate 48, when the printhead carriage 11 rotates in the clockwise direction B1 away from the base plate 2 by an angle θ2. At this time, the centre plane P3 of the printhead 5 rotates to a position indicated by P3-2. Due to the rotation of the printhead carriage 11, the printhead 5 does not align with the substrate 48. The left end of the printhead 5 is separated from the substrate 48 by a first linear distance TL2. The right end of the printhead 5 is separated from the substrate 48 by a second linear distance TR2 which is less than TL2. A difference of TL2 and TR2 indicates an extent of misalignment between the printhead 5 and the substrate 48.

The misalignment reaches its maximum value when the printhead 5 rotates to the end points of its permitted rotational range. In an example, the permitted rotational range of the printhead 5 is +/−1 degree from the neutral point. When θ1 is 1 degree, the difference of TR1 and TL1 is 0.55 mm; and when θ2 is 1 degree, the difference of TL2 and TR2 is 0.55 mm. In other words, the maximum misalignment takes up 27.5% of the nominal print distance PD.

The permitted rotational range of the printhead 5 may be selected such that a maximum misalignment of the printhead 5 with respect to the substrate 48 is at least approximately 0.25 mm. With respect to the nominal print distance, the permitted rotational range of the printhead 5 may be selected such that the maximum misalignment of the printhead 5 with respect to the substrate 48 is between approximately 10% and approximately 50% of the nominal print distance.

While a neutrally aligned substrate 48 is shown in FIGS. 8(*b*) and 8(*c*), in reality the substrate could be misaligned. Since the printhead carriage 11 and the printhead 5 are rotatable around the axis of the rail 34, the printhead 5 is able to adapt its orientation to align with the surface of a misaligned substrate.

While FIG. 5 shows that the first structure 40 is integrally formed with the printhead carriage 11, it would be appreciated that the first structure 40 may be coupled (either directly or indirectly via another component) to the printhead carriage 11 in a different manner. Similarly, the second structure 50 may be coupled to the base plate 2 in any suitable manner (including but not limited to, being integrally formed with the base plate 2). It would be also understood that the configurations of the first and second structures 40, 50 may be swapped such that the second structure 50 comprises a first part and a second part (similar to 41, 42) arranged at opposite sides of the first structure 40. It would be further appreciated that the first and second structures 40, 50 may take different forms or arranged at different positions, depending upon the particular designs of the printer. For example, the second structure 50 may be coupled to the rail 34, and at least a part of the guide structure 36 may surround the rail 34 and the second structure 50, with clearance provided around the second structure 50. In this way, the first structure 40 would be incorporated within the guide structure 36, and cooperates with the second structure 50 to limit the rotation of the printhead carriage 11 around the rail 34. In another example, the second structure 50 may be a part of the base plate (e.g., the lower end of the base plate 2 in FIG. 5 or the part which connects the first base plate plane P1 and the second base plate P2. The above examples are in no way exhaustive.

In the example illustrated by FIGS. 1 to 7, the printhead carriage drive assembly 11*a* employs a rack-pinion arrangement to move the printhead carriage 11 linearly with respect to the base plate 2, and the circular gear 28 is directly coupled to the output shaft 30 of the driving motor. It would be appreciated that the printhead carriage drive assembly 11*a* may be modified in any suitable manner. For example, the circular gear 28 may be coupled to the output shaft 30 via a drive belt. In an alternative example, the rack-pinion arrangement may be replaced by a belt drive arrangement, in which a belt is driven between two (or more) pulleys and the printhead carriage 11 is attached to the belt so as to move linearly with respect to the base plate 2.

Figure 9:
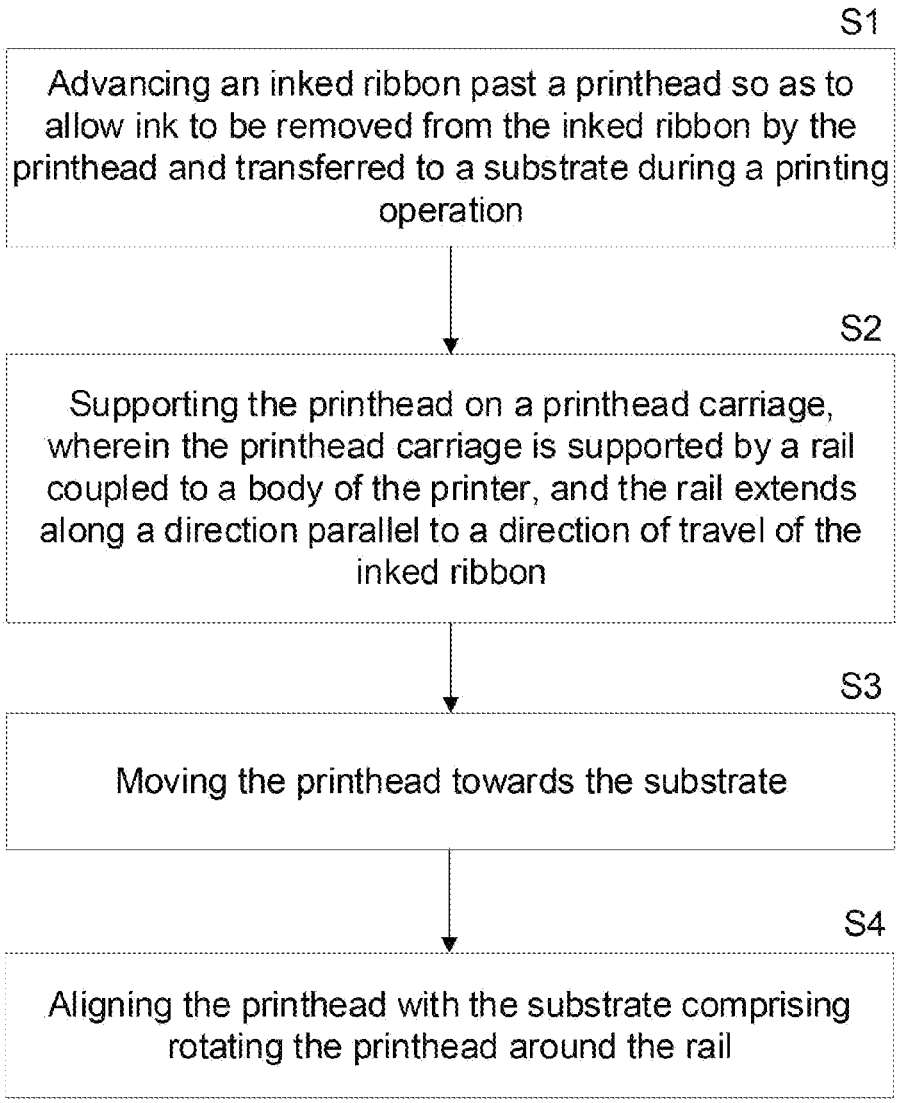
FIG. 9 shows process steps of a method for operating a thermal transfer printer.

FIG. 9 schematically illustrates processing steps of a method for operating a thermal transfer printer (e.g., the printer 1).

At step S1, an inked ribbon (e.g., the inked ribbon 7) is advanced past a printhead (e.g., the printhead 5) so as to allow ink to be removed from the inked ribbon by the printhead and transferred to a substrate during a printing operation.

At step S2, the printhead is supported on a printhead carriage (e.g., the printhead carriage 11). The printhead carriage is supported by a rail (e.g., the rail 34) coupled to a body (e.g., the body 2) of the printer, and the rail extends along a direction (e.g., the axis C1) parallel to a direction of travel of the inked ribbon.

At step S3, the printhead is moved towards the substrate.

At step S4, the printhead is aligned with the substrate, by rotating the printhead around the rail. Rotating the printhead around the rail may comprise rotating the printhead within a limited range of permitted rotation It would be appreciated that in practice, the steps may be performed in a temporal order that is different from the order of description. Further, it would be understood that the method may include additional steps. For example, the method may comprise a step of moving the printhead carriage and the printhead linearly along the rail during a printing operation when the printhead is pressed against the substrate. This step may take place during an intermittent printing mode of the printer.

The terms "having", "containing", "including", "comprising" and the like are open and the terms indicate the presence of stated structures, elements or features but not preclude the presence of additional elements or features. The articles "a", "an" and "the" are intended to include the plural as well as the singular, unless the context clearly indicates otherwise.

The term "about" or "approximately" used in the present disclosure indicate a degree of variability (e.g., 20%) in the stated numerical values.

The skilled person will understand that in the preceding description, positional terms such as 'upper', 'lower', and 'vertical', etc. are made with reference to conceptual illustrations of a printer, such as those showing standard sectional views and those shown in the appended drawings. These terms are used for ease of reference but are not intended to be of limiting nature. These terms are therefore to be understood as referring to a printer when in an orientation as shown in the accompanying drawings.

Although the disclosure has been described in terms of preferred embodiments as set forth above, it should be understood that these embodiments are illustrative only and that the claims are not limited to those embodiments. Those skilled in the art will be able to make modifications and alternatives in view of the disclosure which are contemplated as falling within the scope of the appended claims. Each feature disclosed or illustrated in the present specification may be incorporated in the disclosure, whether alone or in any appropriate combination with any other feature disclosed or illustrated herein.

The invention claimed is:

1. A thermal transfer printer comprising:

a printhead;

a tape drive configured to cause an inked ribbon to be advanced past the printhead so as to allow ink to be removed from the inked ribbon by the printhead and transferred to a substrate during a printing operation; and a printhead carriage on which the printhead is mounted, wherein the printhead carriage is supported by a rail coupled to a body of the printer, and the rail extends along a direction parallel to a direction of travel of the inked ribbon; and wherein the printhead carriage further comprises a first structure which is arranged to engage with a second structure coupled to the body of the printer, and wherein the first and second structures are configured relative to one another to limit a rotation of the printhead carriage around the rail toward the body and away from the body within a predetermined range.

2. A thermal transfer printer according to claim 1, wherein the first and second structures are configured such that, when the first structure abuts against the second structure, the rotation of the printhead carriage reaches an end point of the predetermined range.

3. A thermal transfer printer according to claim 1, wherein the predetermined range is at least approximately 0.25 degree.

4. A thermal transfer printer according to claim 3, wherein the predetermined range is approximately 2 degrees.

5. A thermal transfer printer according to claim 1, wherein the first and second structures are configured such that, a rotation of the printhead carriage relative to the body of the printer remains within a first predetermined limit in a first direction away from the body of the printer, and remains within a second predetermined limit in a second direction towards the body of the printer.

6. A thermal transfer printer according to claim 5, wherein one of the first structure or the second structure comprises a first part and a second part which are arranged such that, when the first part of the first structure or second structure abuts against the other of the first structure or the second structure, the rotation of the printhead carriage reaches the first predetermined limit, and when the second part of the first structure or second structure abuts against the other of the first structure and the second structure, the rotation of the printhead carriage reaches the second predetermined limit.

7. A thermal transfer printer according to claim 6, wherein the first structure or the second structure is arranged between the first and second parts of the first structure or the second structure.

8. A thermal transfer printer according to claim 6, wherein a distance between the first and second parts is greater than a width of the other of the first structure or the second structure along a third direction that is parallel to a surface of the body of the printer.

9. A thermal transfer printer according to claim 1, wherein the rail is fixedly coupled to the body of the printer.

10. A thermal transfer printer according to claim 1, further comprising a support plate secured to the body of the printer, wherein the support plate comprises a pair of brackets and the rail is connected between the pair of brackets.

11. A thermal transfer printer according to claim 1, further comprising:

a printhead carriage drive assembly configured to drive the printhead carriage so that the printhead carriage and the printhead moves linearly along the rail.

12. A thermal transfer printer according to claim 11, wherein the first structure is configured to move linearly with respect to the second structure during a linear motion of the printhead carriage along the rail.

13. A thermal transfer printer according to claim 11, wherein:

the printhead carriage comprises a gear rack, the printhead carriage drive assembly comprises a motor, and a circular gear which is caused to rotate by energization of the motor, and the circular gear is arranged to engage with the gear rack such that a rotation of the circular gear causes linear motion of the printhead carriage along the rail.

14. A thermal transfer printer according to claim 1, wherein the rail is located directly above a centreline of the printhead.

15. A thermal transfer printer according to claim 1, further comprising a drive housing, wherein the drive housing is configured to house the printhead carriage drive assembly, and wherein the drive housing is securable to the body of the printer.

16. A thermal transfer printer according claim 1, wherein the tape drive comprises a take-up spool support for supporting a spool core onto which inked ribbon can be wound to form a take-up spool, and the take-up spool support is configured to permit the spool core to rotate about a rotation axis extending substantially perpendicular from the body of the printer, and wherein the take-up spool support extends in a fourth direction away from the body of the printer.

17. A thermal transfer printer according to claim 16, further comprising a user interface provided on a user interface surface of a user interface housing, wherein the user interface housing extends in the fourth direction away from the body of the printer.

18. A thermal transfer printer according to claim 1, further comprising a printhead in/out drive assembly configured to move the printhead towards and away from the substrate, the printhead in/out drive assembly being supported by the printhead carriage.

19. A thermal transfer printer comprising:

a printhead;

a tape drive configured to cause an inked ribbon to be advanced past the printhead so as to allow ink to be removed from the inked ribbon by the printhead and transferred to a substrate during a printing operation; and a printhead carriage on which the printhead is mounted, wherein the printhead carriage is supported by a rail coupled to a body of the printer, and wherein the printhead carriage is configured to move linearly along the rail, and to rotate around the rail toward the body and away from the body within a limited range of rotation permitted.

20. A method of operating a thermal transfer printer, comprising:

advancing an inked ribbon past a printhead so as to allow ink to be removed from the inked ribbon by the printhead and transferred to a substrate during a printing operation;

supporting the printhead on a printhead carriage, wherein the printhead carriage is supported by a rail coupled to a body of the printer, and the rail extends along a direction parallel to a direction of travel of the inked ribbon;

moving the printhead towards the substrate; and aligning the printhead with the substrate comprising rotating the printhead around the rail either toward the body of the printer or away from the body of the printer.

21. A method of operating a thermal transfer printer according to claim 20, wherein rotating the printhead around the rail comprises rotating the printhead within a limited range of permitted rotation.

* * * * *